US010788774B2

(12) United States Patent
Sato

(10) Patent No.: US 10,788,774 B2
(45) Date of Patent: Sep. 29, 2020

(54) FIXING DEVICE THAT CONTROLS ROTATION SPEED OF PRESS ROLLER, ACCORDING TO TEMPERATURE OF FIXING ELEMENT AT START OF JOB, TYPE OF RECORDING SHEET, AMBIENT TEMPERATURE, AND ELAPSED TIME AFTER START OF PAPER FEED, AND IMAGE FORMING APPARATUS

(71) Applicant: KYOCERA Document Solutions Inc., Osaka (JP)

(72) Inventor: Takehiro Sato, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 16/688,300

(22) Filed: Nov. 19, 2019

(65) Prior Publication Data

US 2020/0166875 A1 May 28, 2020

(30) Foreign Application Priority Data

Nov. 27, 2018 (JP) ..... 2018-221718

(51) Int. Cl.
*G03G 15/20* (2006.01)
*G03G 15/00* (2006.01)
*G03G 21/20* (2006.01)

(52) U.S. Cl.
CPC ..... *G03G 15/2039* (2013.01); *G03G 15/5029* (2013.01); *G03G 21/20* (2013.01); *G03G 2215/2035* (2013.01); *G03G 2215/2045* (2013.01)

(58) Field of Classification Search
CPC ..... G03G 15/2039; G03G 15/5029; G03G 21/20; G03G 2215/2035; G03G 2215/2045
See application file for complete search history.

(56) References Cited

U.S. PATENT DOCUMENTS

2016/0116875 A1* 4/2016 Hazeyama ..... G03G 15/2039 399/67
2017/0185013 A1* 6/2017 Minagawa ..... G03G 15/2039
2018/0246457 A1* 8/2018 Ito ..... G03G 15/5029

FOREIGN PATENT DOCUMENTS

JP 2018-054943 A 4/2018

* cited by examiner

*Primary Examiner* — Joseph S Wong
(74) *Attorney, Agent, or Firm* — IP Business Solutions, LLC

(57) ABSTRACT

A fixing device includes: a fixing element; a heat source heating the fixing element; a press roller pressed against the fixing element, to form with the fixing element a nip region where a recording sheet passes; a driver device rotating the press roller; and a controller controlling the heat source to set a temperature of the fixing element to a predetermined target temperature, and controlling the driver device to set a rotation speed of the press roller to a predetermined target rotation speed. The controller determines the target rotation speed by adding a correction value to a normal rotation speed, based on the temperature of the fixing element at start of job, a type of the recording sheet, ambient temperature, and elapsed time from start of paper feed, and sets the rotation speed of the press roller to the target rotation speed.

6 Claims, 11 Drawing Sheets

Fig.6

| FIXING BELT TEMPERATURE AT START OF JOB | CONTROL LEVEL |
|---|---|
| LOWER THAN 25°C | LEVEL 1 |
| 25°C OR HIGHER, LOWER THAN 40°C | LEVEL 2 |
| 40°C OR HIGHER, LOWER THAN 55°C | LEVEL 3 |
| 55°C OR HIGHER, LOWER THAN 70°C | LEVEL 4 |
| 70°C OR HIGHER, LOWER THAN 85°C | LEVEL 5 |
| 85°C OR HIGHER, LOWER THAN 100°C | LEVEL 6 |
| 100°C OR HIGHER, LOWER THAN 115°C | LEVEL 7 |
| 115°C OR HIGHER, LOWER THAN 130°C | LEVEL 8 |
| 130°C OR HIGHER, LOWER THAN 140°C | LEVEL 9 |
| 140°C OR HIGHER | LEVEL 10 |

Fig.9

| TYPE OF RECORDING SHEET | FIXING BELT TEMPERATURE AT START OF JOB | CORRECTION VALUE |
|---|---|---|
| LOW GRAMMAGE | LOWER THAN 25°C | CORRECTION VALUE A |
| | 25°C OR HIGHER, LOWER THAN 40°C | CORRECTION VALUE B |
| | 40°C OR HIGHER, LOWER THAN 55°C | CORRECTION VALUE C |
| | 55°C OR HIGHER, LOWER THAN 70°C | CORRECTION VALUE D |
| | 70°C OR HIGHER, LOWER THAN 85°C | CORRECTION VALUE E |
| | 85°C OR HIGHER, LOWER THAN 100°C | CORRECTION VALUE F |
| | 100°C OR HIGHER, LOWER THAN 115°C | CORRECTION VALUE G |
| | 115°C OR HIGHER, LOWER THAN 130°C | CORRECTION VALUE H |
| | 130°C OR HIGHER, LOWER THAN 140°C | CORRECTION VALUE I |
| | 140°C OR HIGHER | CORRECTION VALUE J |
| HIGH GRAMMAGE | LOWER THAN 25°C | CORRECTION VALUE K |
| | 25°C OR HIGHER, LOWER THAN 40°C | CORRECTION VALUE L |
| | 40°C OR HIGHER, LOWER THAN 55°C | CORRECTION VALUE M |
| | 55°C OR HIGHER, LOWER THAN 70°C | CORRECTION VALUE N |
| | 70°C OR HIGHER, LOWER THAN 85°C | CORRECTION VALUE O |
| | 85°C OR HIGHER, LOWER THAN 100°C | CORRECTION VALUE P |
| | 100°C OR HIGHER, LOWER THAN 115°C | CORRECTION VALUE Q |
| | 115°C OR HIGHER, LOWER THAN 130°C | CORRECTION VALUE R |
| | 130°C OR HIGHER, LOWER THAN 140°C | CORRECTION VALUE S |
| | 140°C OR HIGHER | CORRECTION VALUE T |

FIXING DEVICE THAT CONTROLS ROTATION SPEED OF PRESS ROLLER, ACCORDING TO TEMPERATURE OF FIXING ELEMENT AT START OF JOB, TYPE OF RECORDING SHEET, AMBIENT TEMPERATURE, AND ELAPSED TIME AFTER START OF PAPER FEED, AND IMAGE FORMING APPARATUS

INCORPORATION BY REFERENCE

This application claims priority to Japanese Patent Application No. 2018-221718 filed on Nov. 27, 2018, the entire contents of which are incorporated by reference herein.

BACKGROUND

The present disclosure relates to a fixing device that fixes an image formed on a recording sheet by holding the recording sheet at a nip region between a fixing element and a press roller, and an image forming apparatus incorporated with the fixing device.

For example, a fixing device is known that fixes an image (toner image unfixed yet) on a recording sheet by heat pressing, at a nip region formed between an endless fixing belt and a press roller pressed against the fixing belt, by holding the recording sheet at the nip region, with the fixing belt being heated by a heater provided inside the fixing belt.

Such a fixing device is configured to supply power to the heater in order to maintain the temperature required for fixing while the image on the recording sheet is subjected to the heat pressing, so as that the fixing belt is heated to a predetermined fixing temperature (target temperature) that enables the image to be fixed when the recording sheet passes the nip region.

SUMMARY

The disclosure proposes further improvement of the foregoing technique.

In an aspect, the disclosure provides a fixing device including a fixing element, a heat source, a press roller, a driver device, and a control device. The heat source heats a circumferential surface of the fixing element. The press roller is pressed against an outer circumferential surface of the fixing element, to form a nip region between the press roller and the fixing element, where the recording sheet to be fixed is to pass. The driver device rotates the press roller. The control device includes a processor, and acts, when the processor executes a control program, as a controller that controls the heat source to set a temperature of the fixing element to a predetermined target temperature, and controls the driver device to set a rotation speed of the press roller to a predetermined target rotation speed. The controller determines the target rotation speed by adding a predetermined correction value to a predetermined normal rotation speed on a basis of the temperature of the fixing element at start of a job, a type of the recording sheet, an ambient temperature, and an elapsed time from start of paper feed, and controls the driver device to set the rotation speed of the press roller to the target rotation speed determined.

In another aspect, the disclosure provides an image forming apparatus including the foregoing fixing device and an image forming device. The image forming device forms an image on the recording sheet. The fixing device heat-presses the image formed on the recording sheet, by holding the recording sheet at the nip region between the fixing element and the press roller.

BRIEF DESCRIPTION OF THE DRAWINGS

FIG. 6 is a table showing a relation between the temperature of the fixing belt at the start of a job and the corresponding control level.

FIG. 9 is a table showing a relation among the temperature of the fixing belt at the start of a job, the type of the recording sheet, and the corresponding correction value.

DETAILED DESCRIPTION

Figure 1:
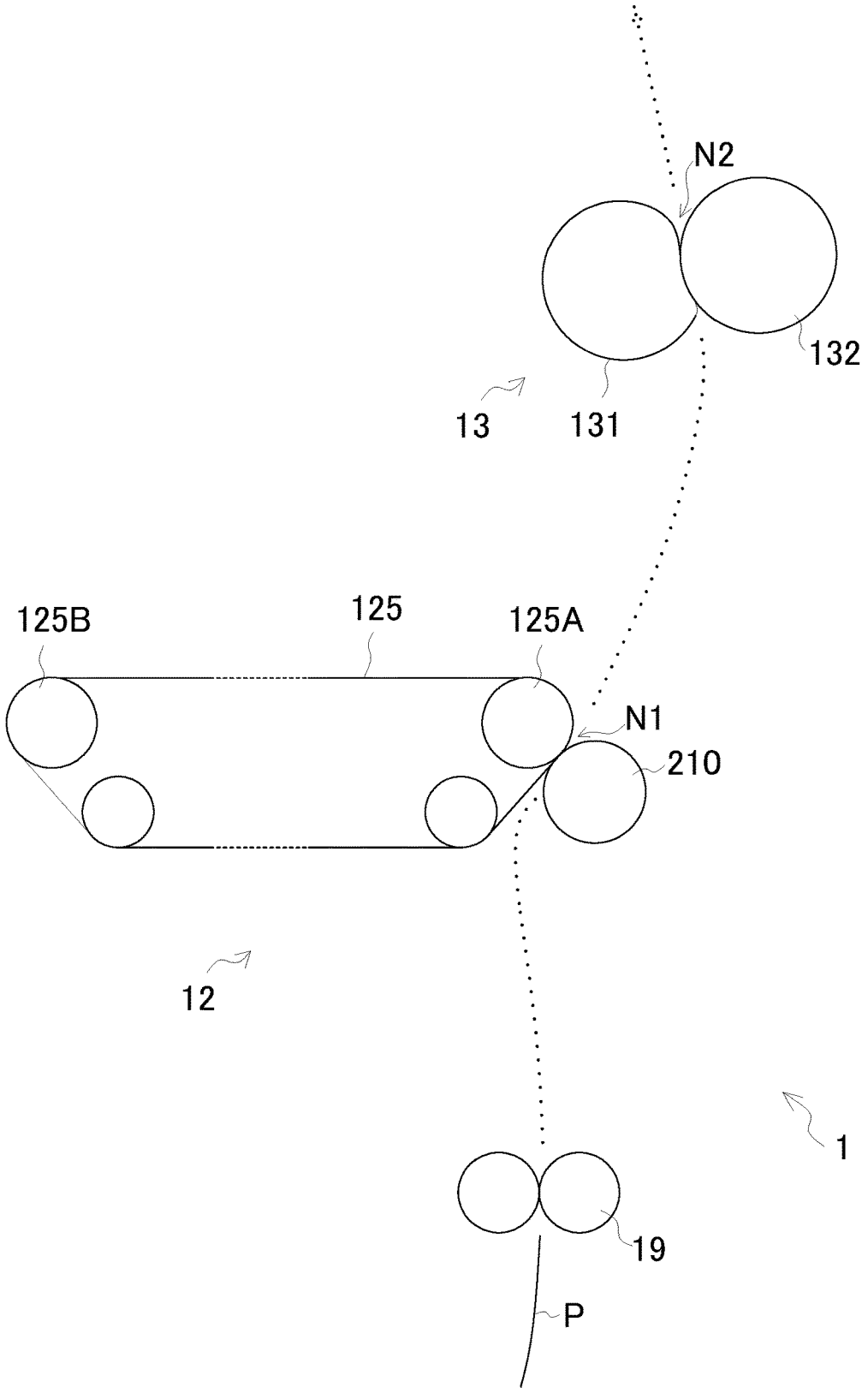
FIG. 1 is a schematic cross-sectional view showing a part of the internal structure of an image forming apparatus, incorporated with a fixing device according to a first embodiment of the disclosure.
Figure 2:
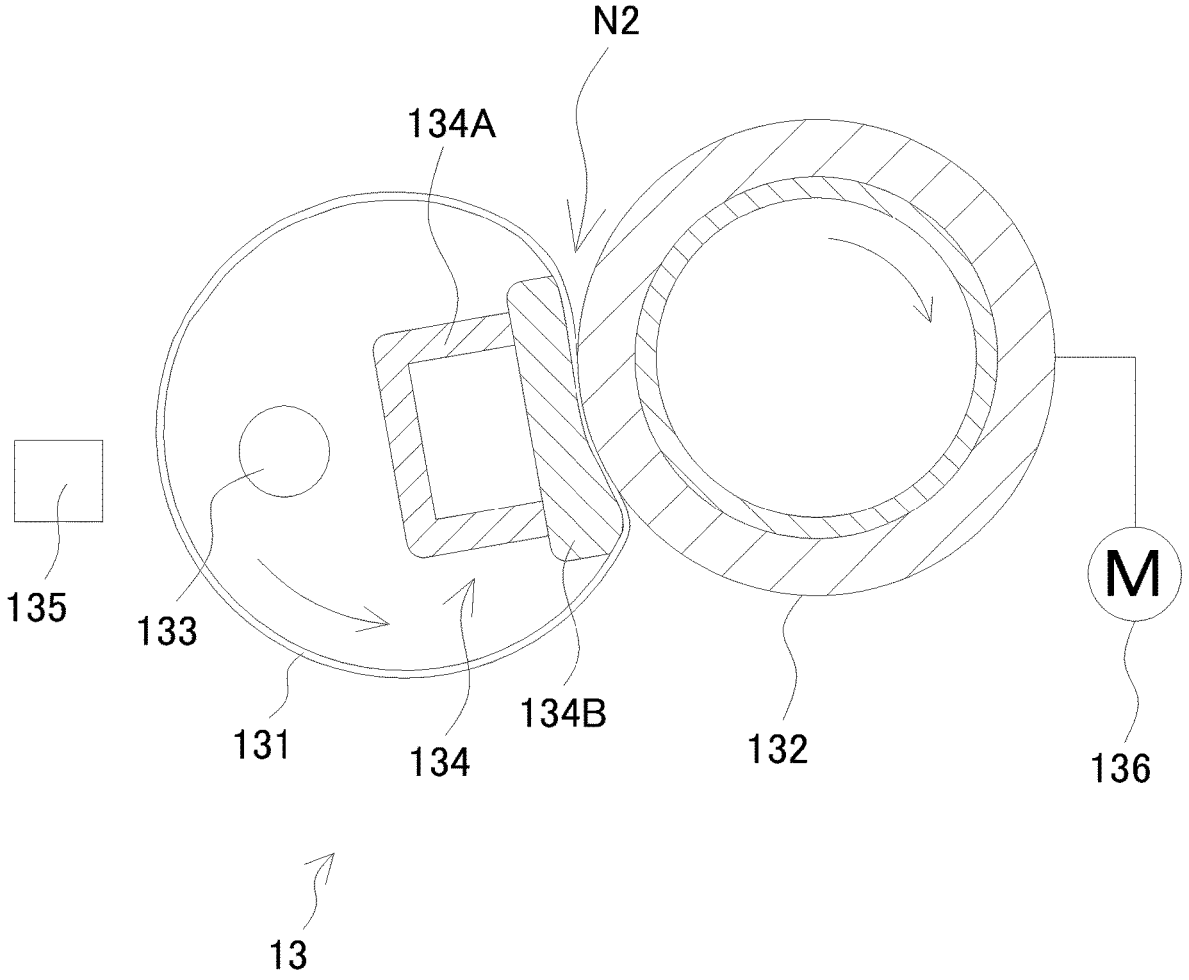
FIG. 2 is a schematic cross-sectional view showing the fixing device according to the first embodiment.

Hereafter, a fixing device and an image forming apparatus according to an embodiment of the disclosure will be described, with reference to the drawings. FIG. 1 is a schematic cross-sectional view showing a part of the internal configuration of the image forming apparatus, incorporated with the fixing device according to a first embodiment of the disclosure. FIG. 2 is a schematic cross-sectional view showing the fixing device according to the first embodiment of the disclosure.

The image forming apparatus 1, incorporated with the fixing device according to the embodiment of the disclosure, is a multifunction peripheral having a plurality of functions, such as copying, printing, scanning, and facsimile transmission. The image forming apparatus 1 includes an image forming device 12 and a fixing device 13.

The image forming device 12 includes an intermediate transfer belt 125, on the outer circumferential surface of which a toner image is to be transferred, a drive roller 125A, a slave roller 125B, a primary transfer roller, and a secondary transfer roller 210.

The intermediate transfer belt 125 is wound over the drive roller 125A and the slave roller 125B, to be driven by the drive roller 125A in contact with the circumferential surface of the photoconductor drum, thus to endlessly run in synchronization with the photoconductor drum.

The secondary transfer roller 210 transfers the toner image transferred to the outer circumferential surface of the intermediate transfer belt 125, onto a recording sheet P transported from a resist roller pair 19, at a nip region N1 formed between the secondary transfer roller 210 and the drive roller 125A, so as to hold the intermediate transfer belt 125. The resist roller pair 19 adjusts the timing at which the recording sheet P transported from a paper feed device is supplied to the nip region N1. An arrow leading a broken line in FIG. 1 indicates the transport direction of the recording sheet P.

The fixing device 13 serves to fix the toner image formed on the sheet P by heat pressing. The fixing device 13 includes a fixing belt 131, a press roller 132, a heater 133, a press device 134, and a thermopile 135.

The fixing belt 131 is an endless belt, formed in a generally cylindrical shape, such that the width direction of the belt constitutes the longitudinal direction of the cylinder, and configured to rotate about its axis. The fixing belt 131 is formed, for example, of a heat-resistant and elastic synthetic resin or the like. The fixing belt 131 exemplifies the fixing element in the disclosure.

The heater 133 and the press device 134 are provided inside the fixing belt 131, so as to extend in the longitudinal direction thereof. The heater 133 heats the circumferential surface of the fixing belt 131. The heater 133 is, for example, a halogen heater, and exemplifies the heat source in the disclosure. Here, the fixing device 13 may include a fixing roller as the fixing element, in place of the fixing belt 131, and a heater that heats the fixing roller, as the heat source.

The press device 134 includes a support member 134A and a press pad 134B. The press pad 134B is formed in a generally rectangular block shape, extending in the longitudinal direction of the fixing belt 131. The press pad 134B is fixed to the support member 134A, to press the fixing belt 131 against the press roller 132.

The thermopile 135 is an infrared sensor that acquires a thermoelectromotive force proportional to an amount of infrared light incident upon the photodetector, and located close to the circumferential surface of the fixing belt 131 to detect the temperature of the fixing belt 131. The thermopile 135 exemplifies the first sensor in the disclosure.

The press roller 132 is formed in a generally cylindrical shape extending in the longitudinal direction of the fixing belt 131, and configured to rotate about its axis. The press roller 132 is formed, for example, of a metal cylindrical body covered with a layer of a synthetic resin or the like, and pressed against the outer circumferential surface of the fixing belt 131, to thereby form a nip region N2 between the press roller 132 and the fixing belt 131, where the recording sheet P to be fixed is to pass.

The press roller 132 is connected to a drive motor 136, for example via a gear, to be driven by the drive motor 136 to rotate clockwise in the drawings. When the press roller 132 rotates, the fixing belt 131 follows up the rotation of the press roller 132, thus to rotate counterclockwise in the drawings. The drive motor 136 exemplifies the driver device in the disclosure.

Figure 3:
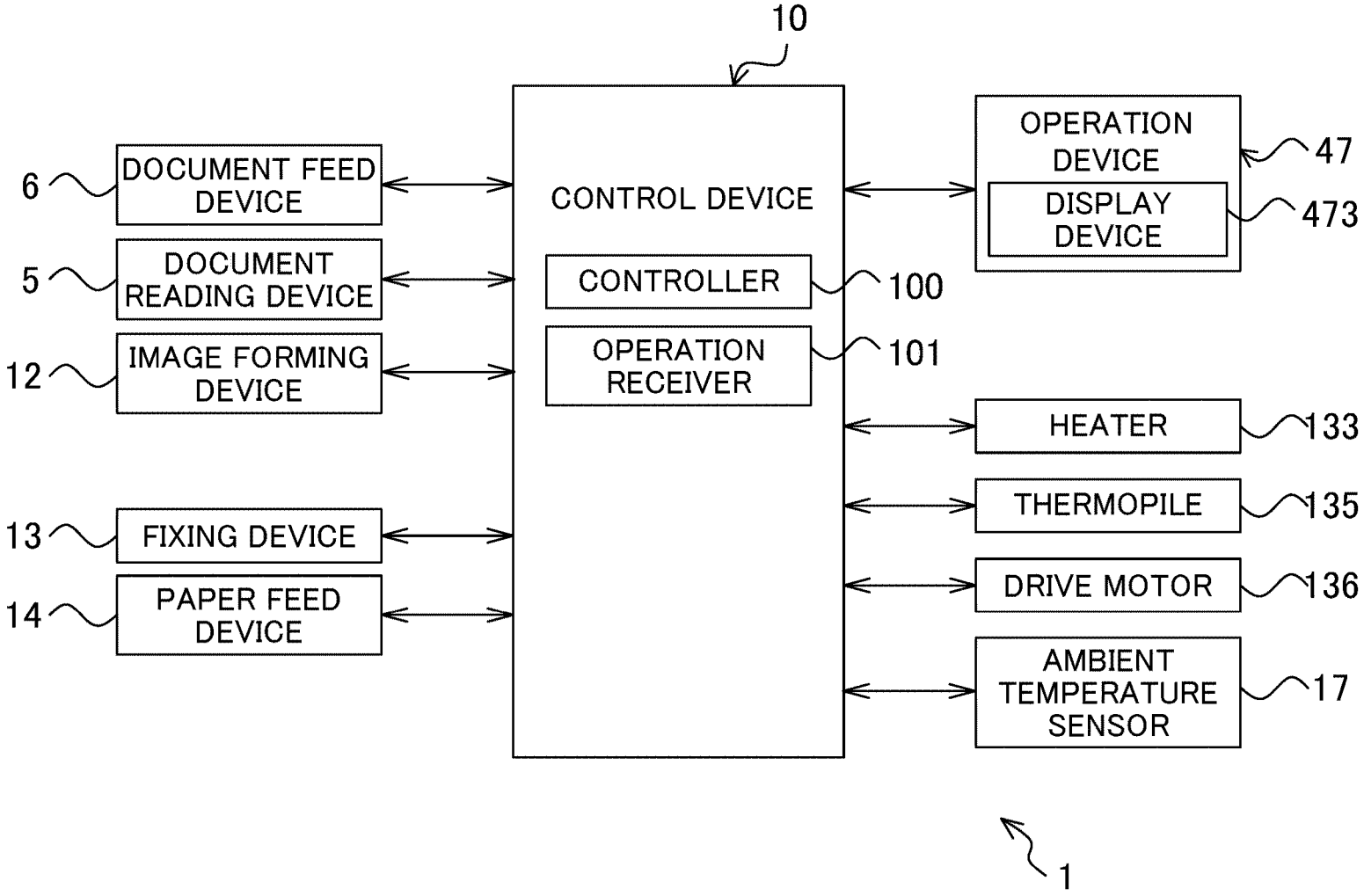
FIG. 3 is a functional block diagram showing an essential internal configuration of the image forming apparatus, incorporated with the fixing device according to the first embodiment.

FIG. 3 is a functional block diagram showing an essential internal configuration of the image forming apparatus 1. The image forming apparatus 1 includes a control device 10, a document feed device 6, a document reading device 5, the image forming device 12, the fixing device 13, a paper feed device 14, an operation device 47, the heater 133, the thermopile 135, the drive motor 136, and an ambient temperature sensor 17.

In the image forming apparatus 1, the document reading operation is performed as follows. The document reading device 5 optically reads the image on a source document delivered from the document feed device 6 or placed on a platen glass, and generates image data. The image data generated by the document reading device 5 is stored, for example, in an image memory.

In the image forming apparatus 1, the image forming operation is performed as follows. The image forming device 12 forms a toner image on the recording sheet P, which is the recording medium delivered from the paper feed device 14, on the basis of the image data generated through the document reading operation, or received from an external device such as a computer, connected via the network.

The fixing device 13 heat-presses, as described above, the recording sheet P having the toner image formed thereon by the image forming device 12, thereby fixing the toner image to the recording sheet P. The recording sheet P that has undergone the fixing process is discharged to an output tray. The paper feed device 14 includes one or more paper cassettes, each including the recording sheet P and configured to feed the recording sheet P to the resist roller pair 19 (see FIG. 1).

The operation device 47 receives instructions from the user, for operations and processes that the image forming apparatus 1 is configured to perform, for example the image forming operation. The operation device 47 includes a display device 473 for displaying a guidance and so forth for the user.

The display device 473 has a touch panel function, so that the user can operate the image forming apparatus 1, by touching a button or a key displayed on the screen. The ambient temperature sensor 17 is provided on the main body of the image forming apparatus 1, and detects a temperature of a region outside the apparatus. The ambient temperature sensor 17 exemplifies the second sensor in the disclosure.

The control device 10 includes a processor, a random-access memory (RAM), a read-only memory (ROM), and an exclusive hardware circuit. The processor is, for example, a central processing unit (CPU), an application specific integrated circuit (ASIC), or a micro processing unit (MPU).

The control device 10 acts as a controller 100 and an operation receiver 101, when the processor executes a control program stored, for example, in the HDD 92. However, the controller 100 may be constituted of hardware circuits, instead of being operated by the control device 10 in accordance with the control program. This also applies to other embodiments, unless otherwise specifically noted.

The controller 100 serves to control the overall operation of the image forming apparatus 1. The controller 100 is connected to the document feed device 6, the document reading device 5, the image forming device 12, the fixing device 13, the paper feed device 14, the operation device 47, the heater 133, the thermopile 135, the drive motor 136, and the ambient temperature sensor 17, and controls the operation of the mentioned components. Here, the controller 100 serves as the controller of the image forming apparatus 1, as well as the controller of the fixing device 13.

The operation receiver 101 receives operational inputs from the user, through the operation device 47. For example, the operation receiver 101 receives the inputs made by the user through a hard key provided in the operation device 47, and also receives, by means of the touch panel function, an operation made by the user on the operation screen displayed on the display device 473.

When the operation receiver 101 receives an instruction to execute a print job (a copying job inclusive) from the user, the controller 100 determines a target temperature (fixing temperature) of the fixing belt 131 on the basis of the type of the recording sheet P to be printed (also to be fixed), and the ambient temperature detected by the ambient temperature sensor 17, and controls the heater 133 so as to allow the temperature of the fixing belt 131 to accord with the target temperature determined. In other words, the controller 100 controls the heater 133, such that the temperature detected by the thermopile 135 accords with the target temperature.

When the recording sheet P has a high grammage, or when the ambient temperature is low, a larger amount of heat is removed from the fixing belt 131, when the recording sheet P passes the nip region. In addition, when the ambient temperature is low, normally the fixing belt 131 also has a low temperature. Accordingly, when the recording sheet P has a high grammage, or when the ambient temperature is low, the target temperature to be utilized by the controller 100 to control the heater 133 is set to a predetermined high-side temperature.

The controller 100 also controls the paper feed device 14, so as to feed the recording sheet P to be printed and fixed from the paper feed device 14 (primary paper feed), and transport the recording sheet P to the resist roller pair 19 (see FIG. 1). The controller 100 then controls the resist roller pair 19 so as to feed the recording sheet P to the nip region N1 and the nip region N2 (see FIG. 1) (secondary paper feed), at an appropriate timing for the printing. Here, the position of the resist roller pair 19, the position of the nip region N1, and the position of the nip region N2 respectively corresponds to the resist position, the printing position, and the fixing position in the disclosure.

Figure 4:
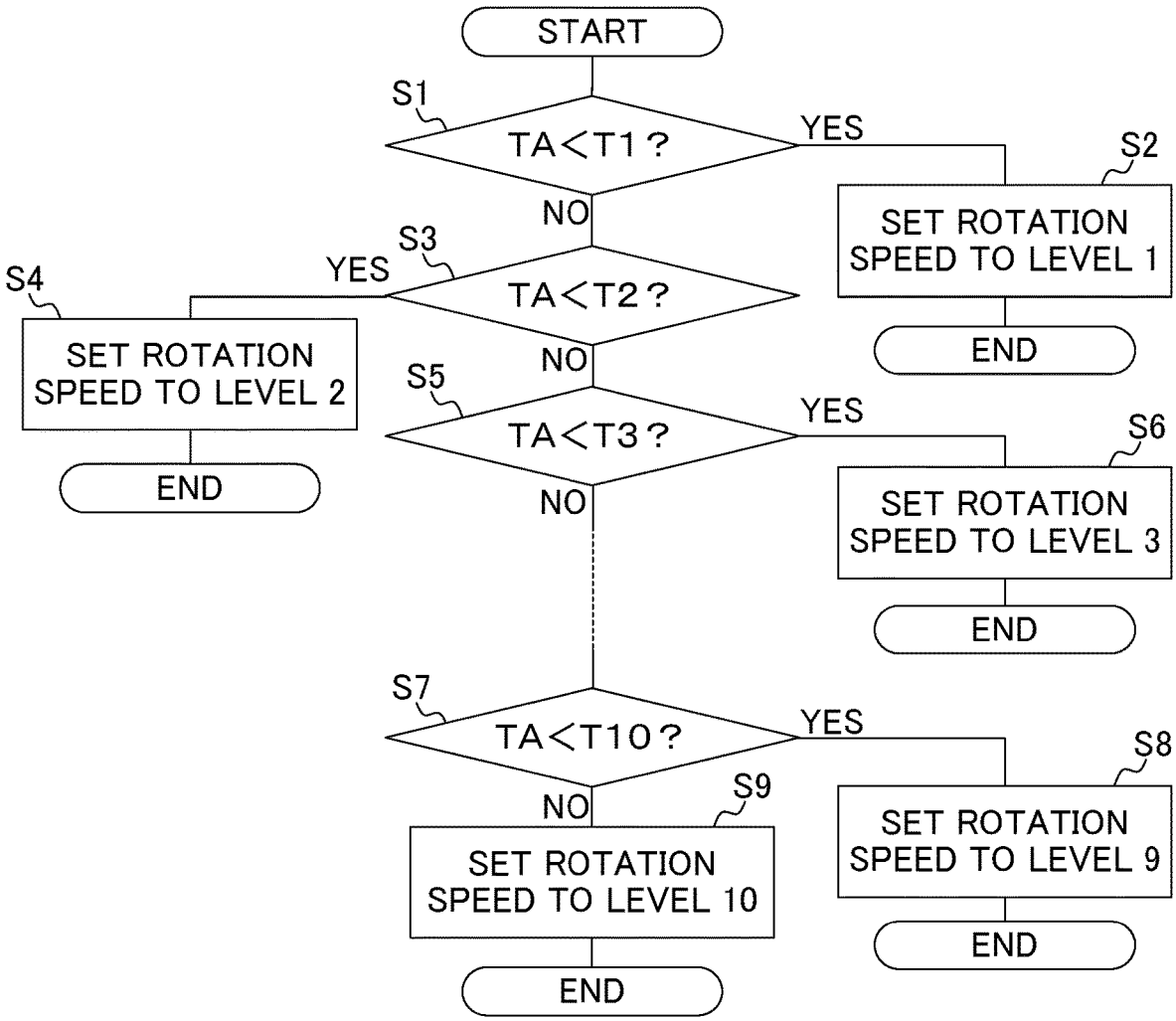
FIG. 4 is a flowchart showing an operation performed by a control device of the image forming apparatus incorporated with the fixing device according to the first embodiment.

Referring now to a flowchart of FIG. 4, an operation performed by the control device 10 of the image forming apparatus 1 will be described hereunder. The following operation is performed when the operation receiver 101 receives the instruction to execute a print job from the user, and starts the execution of the print job, which requires the fixing operation.

First, the controller 100 decides whether a temperature TA of the fixing belt 131 at the start of the print job, detected by the thermopile 135, is lower than a predetermined threshold T1 (e.g., 25° C., when the fixing temperature to be reached as the target is 180° C., which applies to subsequent cases) (step S1).

Upon deciding that the temperature TA is lower than the threshold T1 (YES at step S1), the controller 100 sets the rotation speed (per unit time) of the press roller 132 to "level 1" determined by calculation in advance (step S2), and finishes the operation. The levels 1 to 10 are predetermined rotation speeds for promptly raising the temperature of the press roller 132 to the fixing temperature, with respect to different temperatures TA of the fixing belt 131 at the start of the print job. The controller 100 also varies the drive voltage for activating the heater 133, for each of the levels 1 to 10. More specifically, the controller 100 supplies a larger power to drive the heater 133 for a certain period of time, when the temperature TA is lower, because the lower the temperature TA is, the larger amount of heat has to be supplied in a short time to heat the fixing belt 133. When the temperature TA of the fixing belt 131 detected by the thermopile 135 has reached the target temperature, the controller 100 switches the power for driving the heater 133, to such a level that allows the target temperature to be maintained.

To raise the temperature of the fixing belt 131 to the fixing temperature, the larger amount of heat has to be supplied to the fixing belt 131 from the heater 133, the lower the temperature TA is. In addition, to uniformly heat the fixing belt 131 thereby promptly raising the temperature of the fixing belt 131 to the target temperature, it is necessary to increase the rotation speed of the press roller 132, thus to increase the rotation speed (belt running speed) of the fixing belt 131. On the other hand, when the fixing belt 131 is heated as above, not only the fixing belt 131 but also the press roller 132, engaged with the fixing belt 131 to rotate therewith, is heated. Because of this, the diameter of the press roller 132 is increased by thermal expansion, and therefore the circumferential speed of the press roller 132 becomes faster than that of the press roller 132 in an unexpanded state. When the press roller 132 is thus expanded, the recording sheet P is transported through the nip region between the fixing belt 131 and the press roller 132 at a higher speed than the target transport speed, which leads to improper transport of the recording sheet P. After the temperature of the fixing belt 131 has reached the target temperature, therefore, it is necessary to reduce the rotation speed of the press roller 132 in proportion to the expansion thereof, thus to allow the circumferential speed of the press roller 132 to accord with the target transport speed of the recording sheet P.

For such control of the rotation speed of the press roller 132, a plurality of control levels, such as the levels 1 to 10, are prepared, for different temperatures TA of the fixing belt 131 at the start of the print job. In other words, correction values (first correction values) that are different from each other are employed to control the rotation speed of the press roller 132, with respect to the different temperatures TA of the fixing belt 131.

Figure 5:
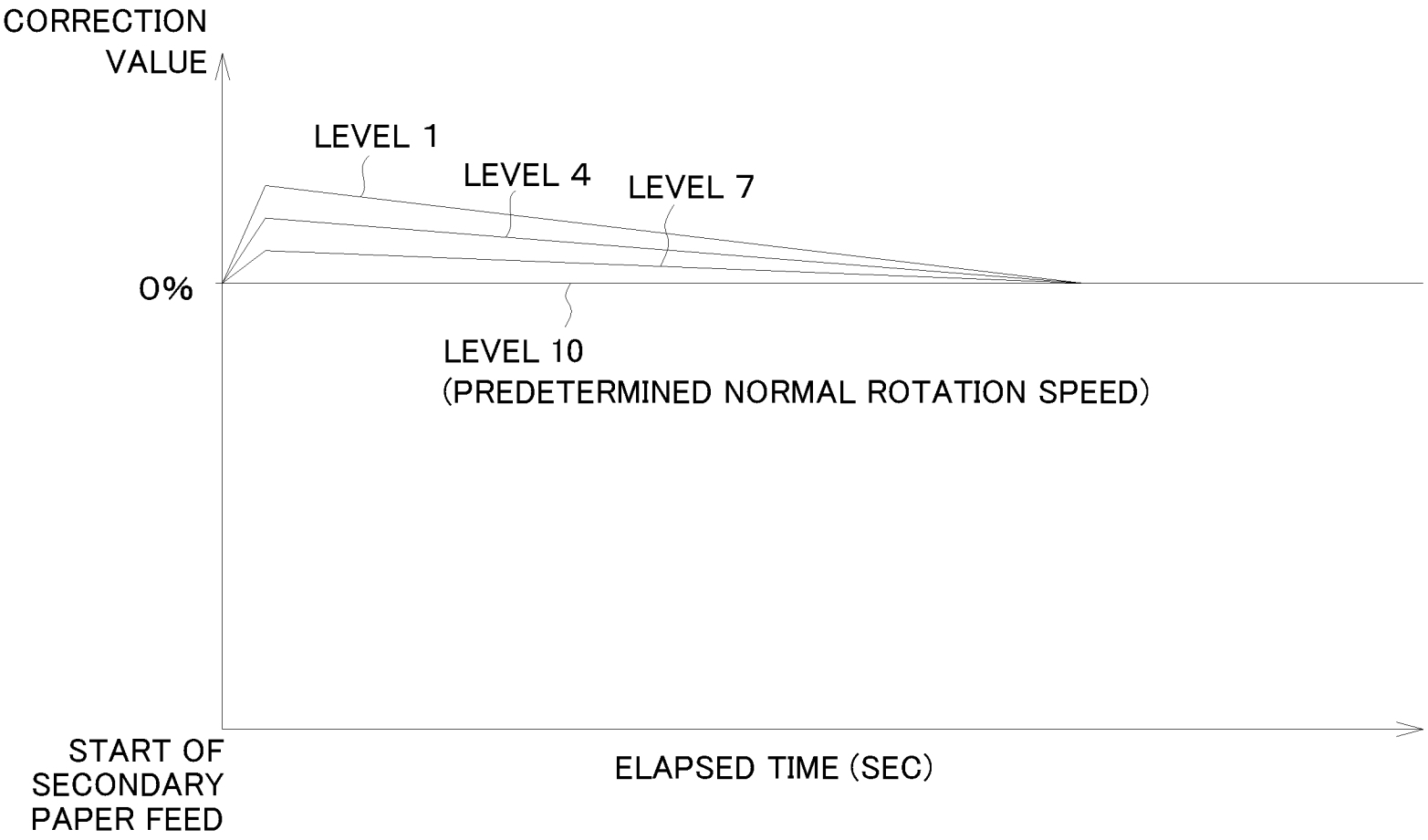
FIG. 5 is a graph showing correction values employed to control rotation speed of a press roller, applied to different control levels determined depending on a temperature of a fixing belt at the start of a job.

FIG. 5 is a graph showing the correction values employed to control the rotation speed of the press roller 132, with respect to the "level 1", "level 4", "level 7", and "level 10" as examples, which are applied to different temperatures TA of the fixing belt 131 at the start of the job. The correction value is to be added to a predetermined normal rotation speed, utilized by the controller 100 to control the rotation of the press roller 132.

In the graph of FIG. 5, the correction values respectively corresponding to "level 1", "level 4", "level 7", and "level 10" are indicated. The correction values respectively corresponding to "level 1", "level 4", "level 7", and "level 10" are each specified so as to vary with the elapsed time after the start of the secondary paper feed.

The correction values corresponding to "level 1", "level 4", and "level 7" in the graph of FIG. 5 each increase with the lapse of time from the start of the secondary paper feed, and then decrease, until finally the correction rates converge on "0%". In the case of "level 1" in particular, the correction value sharply increases immediately after the start of the secondary paper feed. "Level 1" is applied when the temperature TA of the fixing belt 131 is lower than the threshold T1 (e.g., 25° C.), and the fixing belt 131 and the press roller 132 each have a relatively low temperature.

At "level 1", "level 4", and "level 7", the fixing belt 131 is uniformly heated, and the rotation speed (belt running speed) of the fixing belt 131 is increased by increasing the rotation speed of the press roller 132, so as to promptly raise the temperature of the entirety of the fixing belt 131 to the target temperature.

Upon deciding that the temperature TA is not lower than the threshold T1 (NO at step S1), the controller 100 decides whether the temperature TA is lower than a predetermined threshold T2 (e.g., 40° C.) (step S3).

Upon deciding that the temperature TA is lower than the threshold T2 (YES at step S3), the controller 100 sets the rotation speed of the press roller 132 to "level 2" determined by calculation in advance (step S4), and finishes the operation.

Upon deciding, in contrast, that the temperature TA is not lower than the threshold T2 (NO at step S3), the controller 100 decides whether the temperature TA is lower than a predetermined threshold T3 (e.g., 55° C.) (step S5).

Upon deciding that the temperature TA is lower than the threshold T3 (YES at step S5), the controller 100 sets the rotation speed of the press roller 132 to "level 3" determined by calculation in advance (step S6), and finishes the operation.

The controller 100 repeats similar operations, and then decides whether the temperature TA is lower than a predetermined threshold T10 (e.g., 140° C.) (step S7).

Upon deciding that the temperature TA is lower than the threshold T10 (YES at step S7), the controller 100 sets the rotation speed of the press roller 132 to "level 9" determined by calculation in advance (step S8), and finishes the operation.

In contrast, upon deciding that the temperature TA is not lower than the threshold T10 (NO at step S7), the controller 100 sets the rotation speed of the press roller 132 to "level 10" determined by calculation in advance (step S9), and finishes the operation.

Thus, as the temperature TA rises from a lower side to a higher side, one of the series of levels 1 to 10 is selected as the rotation speed of the press roller 132. FIG. 6 is a table showing a relation between the temperature TA of the fixing belt 131 at the start of the print job and the corresponding control level. "Level 10" is applied when the temperature TA of the fixing belt 131 is equal to or higher than the threshold T10 (e.g., 140° C.), and the press roller 132 has a sufficient heat reserving volume. To "level 10" the correction value of "0" is applied as indicated by the graph of FIG. 5, in other words the correction rate is constantly "0%", and therefore a basic control, in which the predetermined normal rotation speed is applied as it is, is executed by the controller 100.

Referring now to flowcharts of FIG. 7A and FIG. 7B, an operation performed by the control device 10 of the image forming apparatus 1 will be described hereunder. The following operation is performed when the operation receiver 101 receives the instruction to execute a print job from the user, and starts the execution of the print job.

First, the controller 100 decides whether the ambient temperature at the start of the print job, detected by the ambient temperature sensor 17, is equal to or lower than a predetermined threshold T11 (e.g., 10° C.) (step S11).

Upon deciding that the ambient temperature is equal to or lower than the threshold T11 (YES at step S11), the controller 100 decides whether the recording sheet P is of a predetermined type not high in grammage (relatively thin recording sheet) (step S12).

Upon deciding that the recording sheet P is of the relatively thin type (YES at step S12), the controller 100 decides whether the temperature TA of the fixing belt 131 at the start of the print job, detected by the thermopile 135, is lower than the threshold T1 (step S13).

Upon deciding that the temperature TA is lower than the threshold T1 (YES at step S13), the controller 100 sets the correction value to be applied to the rotation speed of the press roller 132 to a predetermined "correction value A" (step S14), and finishes the operation.

The correction value A, and correction values B to T referred to hereunder, are adjustment values to be added for further correction of the rotation speed of the press roller 132, set by the controller 100 to one of the levels 1 to 10, on the basis of the type of the recording sheet P and the ambient temperature. In other words, the correction values A to T are adopted, in further consideration of the impact of the type of the recording sheet P and the ambient temperature on the extent of expansion of the press roller 132, to adjust the rotation speed of the press roller 132 controlled by the controller 100, such that the circumferential speed of the press roller 132 accords with the target transport speed of the recording sheet P. As the correction values A to T, values that are different depending on the elapsed time from the start of the secondary paper feed are determined through experiments carried out in advance, on the basis of the type of the recording sheet P, the ambient temperature, the power necessary to drive the heater 133, the properties of the press roller 132, and the temperature TA. Here, the correction values A to T each exemplify the second correction value in the disclosure.

Figure 8:
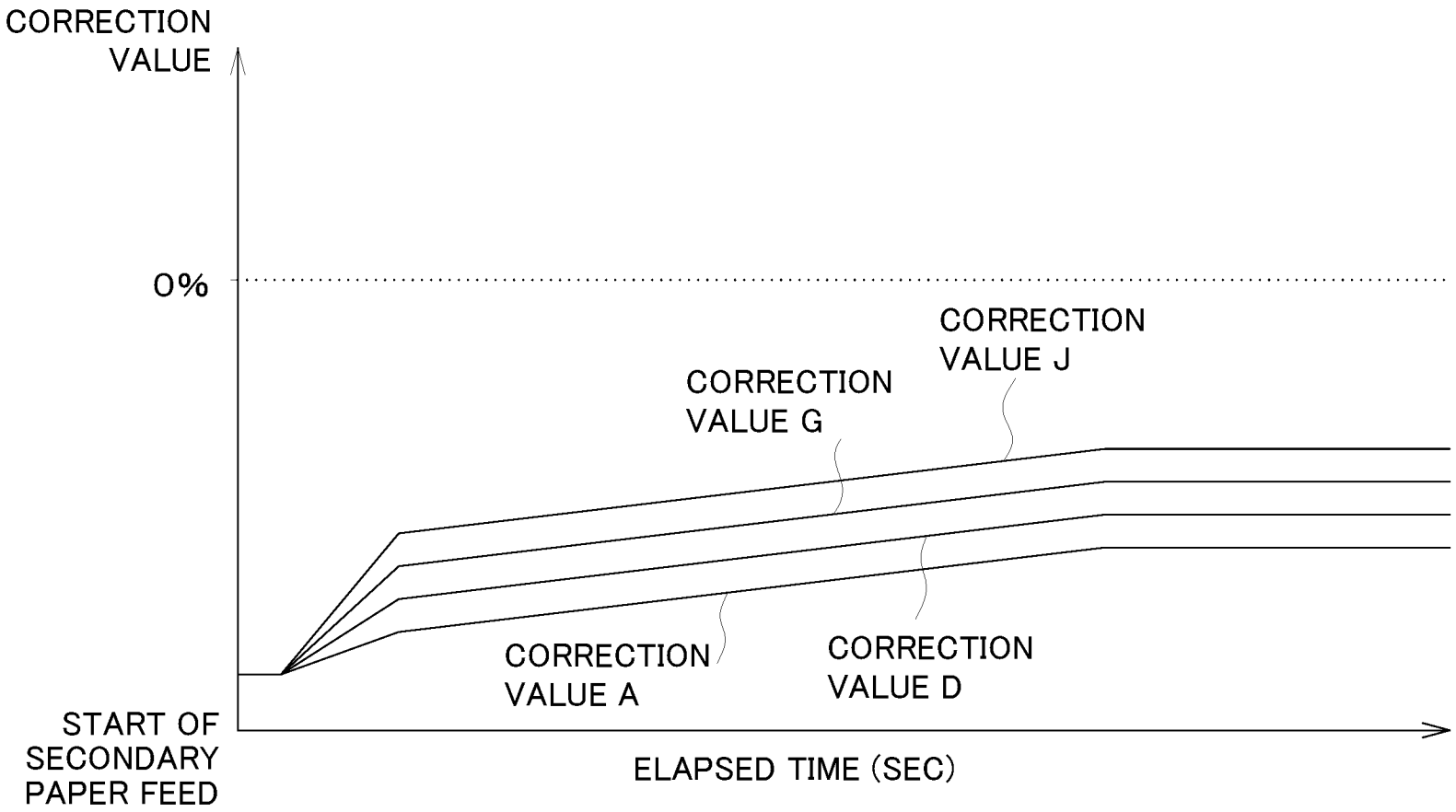
FIG. 8 is a graph showing correction values for different rotation speeds of the press roller.

FIG. 8 is a graph showing the "correction value A" and some other correction values for different rotation speeds of the press roller 132. The correction values A to T each constantly assume a negative value, to reduce the rotation speed of the press roller 132. The correction values A to T each assume a largest value to the negative side immediately after the start of the secondary paper feed, and then the negative value gradually decreases. In FIG. 8, "correction value A", "correction value D", "correction value G", and "correction value J" are illustrated as examples, out of the correction values A to T.

Upon deciding that the temperature TA is not lower than the threshold T1 (NO at step S13), the controller 100 decides whether the temperature TA is lower than the threshold T2 (step S15).

Upon deciding that the temperature TA is lower than the threshold T2 (YES at step S15), the controller 100 sets the correction value to be applied to the rotation speed of the press roller 132 to "correction value B" determined by calculation in advance (step S16), and finishes the operation.

Upon deciding that the temperature TA is not lower than the threshold T2 (NO at step S15), the controller 100 decides whether the temperature TA is lower than the threshold T3 (step S17).

Upon deciding that the temperature TA is lower than the threshold T3 (YES at step S17), the controller 100 sets the correction value to be applied to the rotation speed of the press roller 132 to "correction value C" determined by calculation in advance (step S18), and finishes the operation.

The controller 100 repeats similar operations, and then decides whether the temperature TA is lower than the threshold T10 (step S19). Upon deciding that the temperature TA is lower than the threshold T10 (YES at step S19), the controller 100 sets the correction value to be applied to the rotation speed of the press roller 132 to "correction value I" determined by calculation in advance (step S20), and finishes the operation.

Upon deciding that the temperature TA is not lower than the threshold T10 (NO at step S19), the controller 100 sets the correction value to be applied to the rotation speed of the press roller 132 to "correction value J" determined by calculation in advance (step S20), and finishes the operation. The correction value J is applied when the temperature TA of the fixing belt 131 at the start of the print job is equal to or higher than the threshold T10 (e.g., 140° C.), in other words the fixing belt 131 is sufficiently heated, and the press roller 132 has a sufficient heat reserving volume.

Figure 7A:
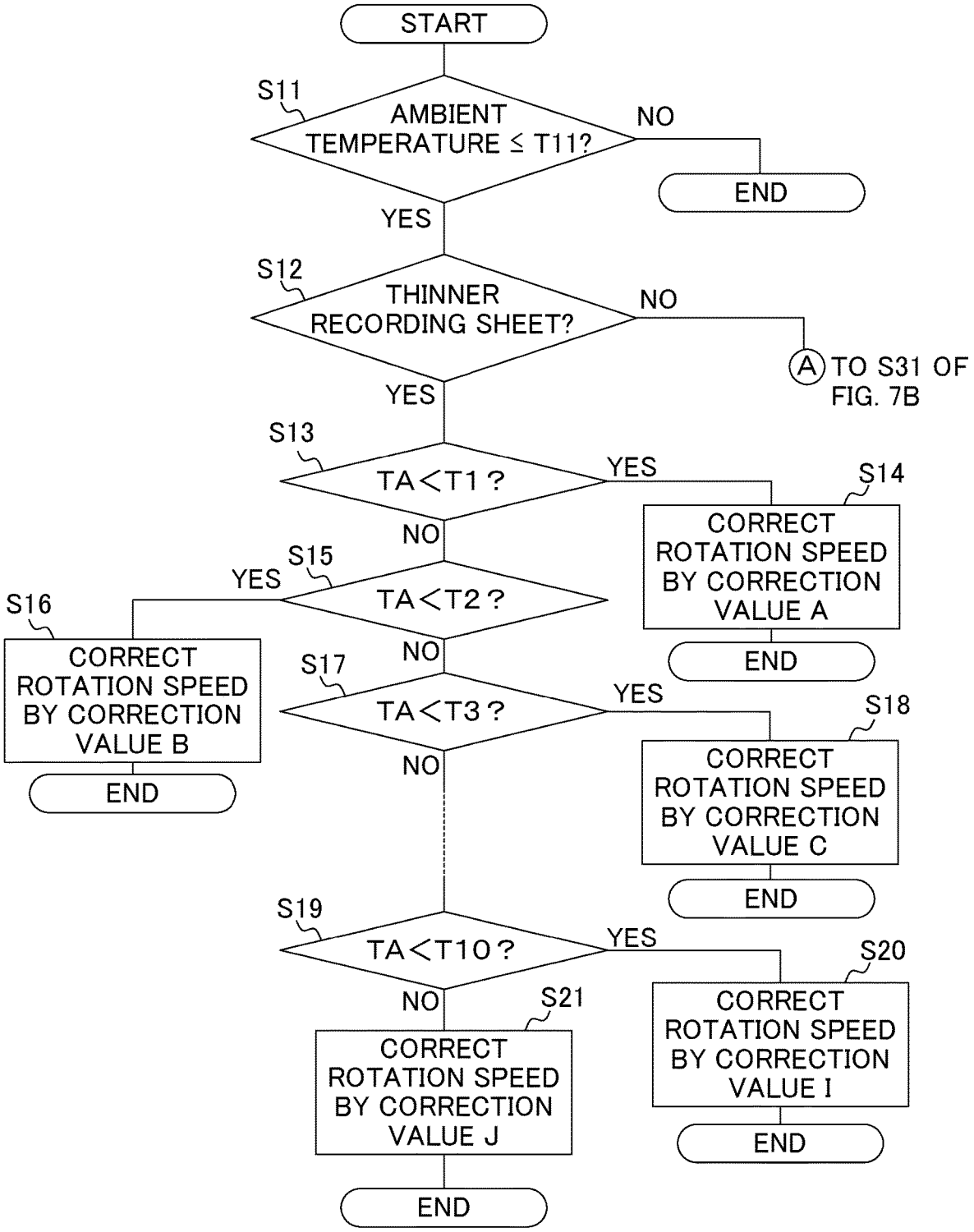
FIG. 7A is a flowchart showing another operation performed by the control device of the image forming apparatus incorporated with the fixing device according to the first embodiment.
Figure 7B:
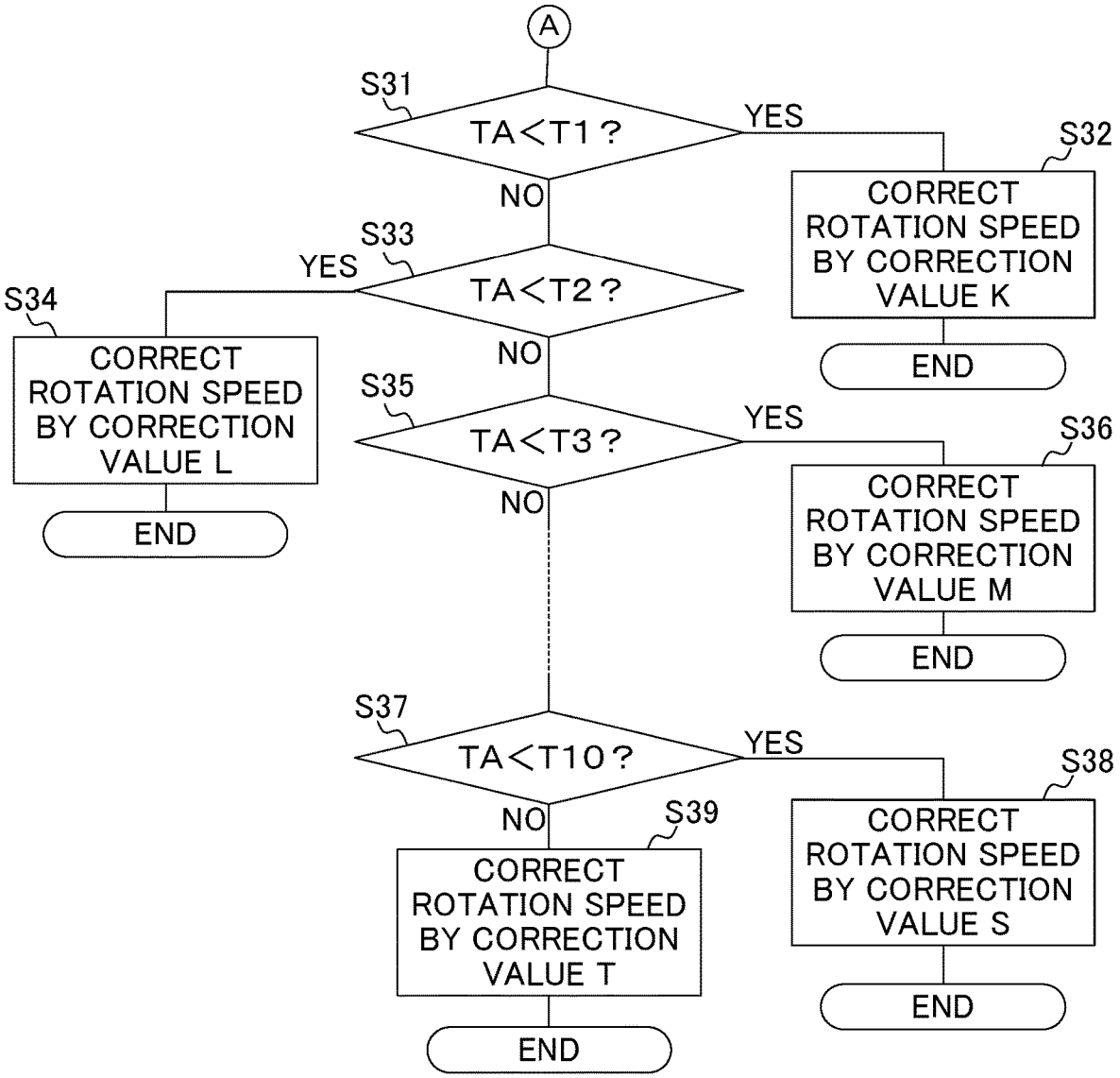
FIG. 7B is a flowchart showing another operation performed by the control device of the image forming apparatus incorporated with the fixing device according to the first embodiment.

When it is decided at step S12 that the recording sheet P is not relatively thin, in other words relatively thick (NO at step S12), the controller 100 decides whether the temperature TA of the fixing belt 131 at the start of the print job is lower than the threshold T1 (step S31 in FIG. 7B).

Upon deciding that the temperature TA is lower than the threshold T1 (YES at step S31), the controller 100 sets the correction value to be applied to the rotation speed of the press roller 132 to "correction value K" determined by calculation in advance (step S32), and finishes the operation. Thereafter, the controller 100 executes similar operations to step S15 to step S21 in FIG. 7A, and sets the correction value to be applied to the rotation speed of the press roller 132 to one of the correction values L to T.

Further, when it is decided at step S11 in FIG. 7A that the ambient temperature is not equal to or lower than the threshold T11 (NO at step S11), the controller 100 does not set any correction value for the rotation speed of the press roller 132, and finishes the operation leaving the status as it is.

FIG. 9 is a table showing a relation among the temperature TA of the fixing belt 131 at the start of the printing job, the type of the recording sheet P, and the corresponding correction value. The correction value T is applied when the ambient temperature is equal to or lower than the threshold T11 (e.g., 10° C.), the recording sheet P is relatively thick, and the temperature of the fixing belt 131 at the start of the print job is equal to or higher than the threshold T10 (e.g., 140° C.).

Upon starting the secondary paper feed, the controller 100 activates a timer incorporated in the control device 10 as from the starting time of the secondary paper feed, selects one of the levels 1 to 10 according to the elapsed time provided by the timer, and controls the rotation of the press roller 132, on the basis of the target rotation speed obtained by adding the correction value for the selected level and one of the correction values A to T (i.e., both of the first correction value and the second correction value), to the predetermined normal rotation speed utilized by the controller 100 to control the rotation of the press roller 132. Therefore, the correction values shown in FIG. 5 and the correction values shown in FIG. 9 are the values to be added to the predetermined normal rotation speed, to allow the circumferential speed of the press roller 132 in the expanded state to accord with the target transport speed.

For example, when the ambient temperature is equal to or lower than the threshold T11, the recording sheet P is relatively thin, and the temperature TA of the fixing belt 131 at the start of the print job is lower than the threshold T1, the controller 100 selects "level 1" as the rotation speed of the press roller 132, and "correction value A" as the correction value. Accordingly, the controller 100 controls the drive motor 136 thereby controlling the rotation speed of the press roller 132, on the basis of the target rotation speed obtained by adding the correction value for "level 1" and "correction value A", selected according to the elapsed time provided by the timer, to the predetermined normal rotation speed.

Figure 10:
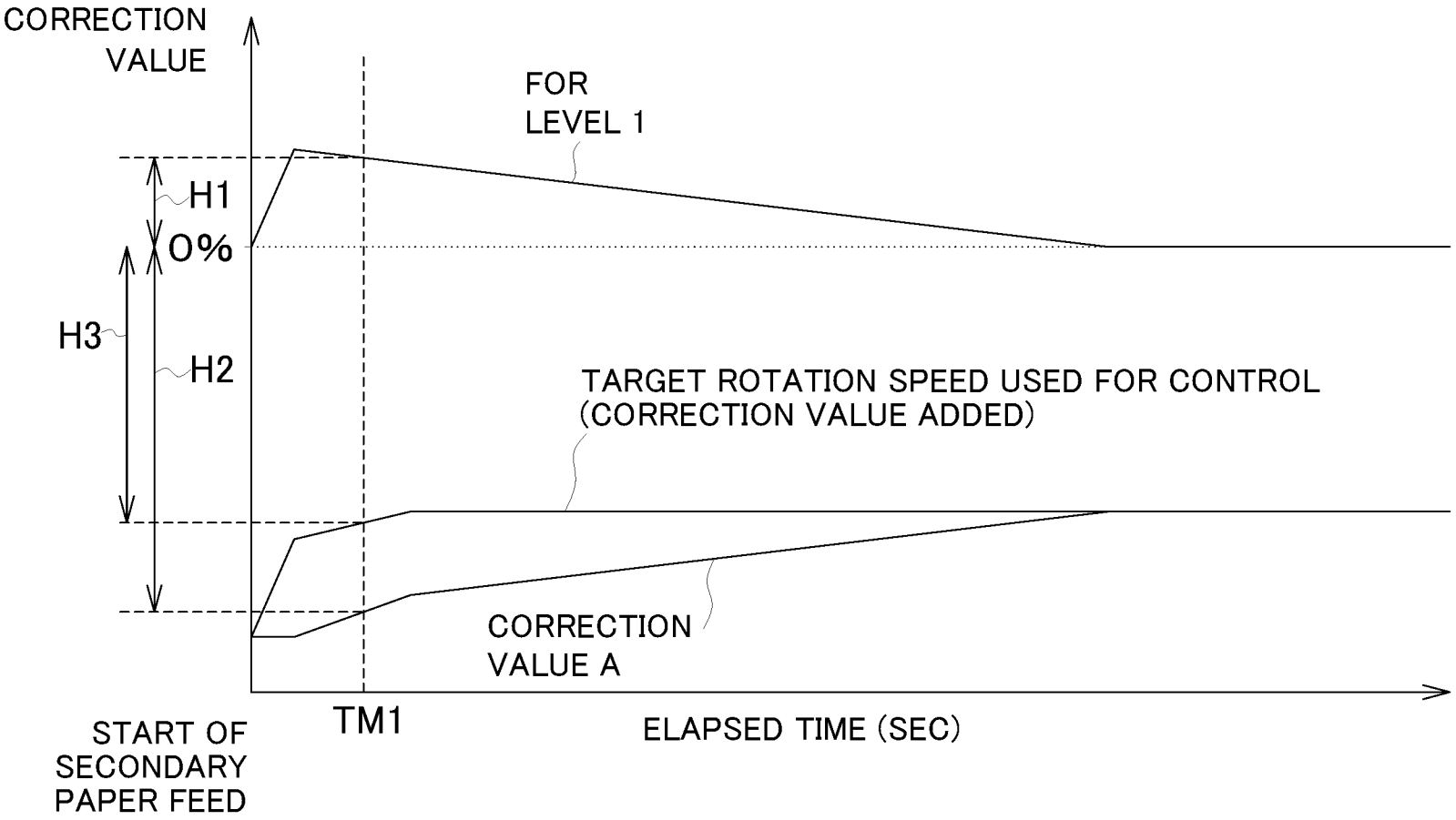
FIG. 10 is a graph showing a target rotation speed obtained by adding a first correction value and a second correction value, to a predetermined normal rotation speed of the press roller.

FIG. 10 is a graph showing the target rotation speed employed for the actual control, obtained by adding the correction value corresponding to "level 1" and the correction value corresponding to "correction value A", to the predetermined normal rotation speed. For example, when a correction value H1 corresponding to "level 1" at a time point TM1 after the start of the secondary paper feed is "2%", and a correction value H2 corresponding to "correction value A" is "−8%", a target rotation speed H3 used for the actual control becomes "−6%".

Now, when the recording sheet passes the nip region, the heat of the fixing belt is removed by the recording sheet. In particular, when a cool recording sheet having a high grammage passes the nip region (i.e., when the ambient temperature is low and a relatively thick recording sheet passes the nip region), a larger amount of heat is removed from the fixing belt. In addition, when the ambient temperature is low, most likely the fixing belt is cooled. Accordingly, when the recording sheet has a high grammage, or when the ambient temperature is low, the fixing belt requires a larger amount of heat, and therefore the target temperature has to be set to a high level. Normally, the existing image forming apparatuses are configured to control as above.

However, when the target temperature is set to a high level, a larger amount of heat is transmitted not only to the fixing belt, but to the press roller pressed against the fixing belt. When a larger amount of heat is transmitted to the press roller, the press roller is expanded. Accordingly, the outer diameter of the press roller is increased, and the circumferential speed of the press roller is increased, despite the rotation speed remaining unchanged. When the transport speed of the recording sheet changes owing to the increase in circumferential speed of the press roller, the transport performance of the recording sheet becomes unstable, which may result in appearance of a streak in the image, or a wrinkle of the recording sheet.

In the existing fixing devices, the press roller and the fixing belt are spaced from each other when the fixing belt is heated, to prevent the heat of the fixing belt from being removed by the press roller. However, such an arrangement requires an additional mechanism, to move the press roller and the fixing belt away from and toward each other. In addition, whereas the fixing belt in contact with the press roller is normally driven to rotate by the rotation of the press roller, an additional driving mechanism has to be provided for the fixing belt in order to rotate the fixing belt spaced from the press roller, which results in further complication of the structure.

With the configuration according to the foregoing embodiment, in contrast, the rotation speed of the press roller 132 is corrected to the slower side when the outer diameter of the press roller 132 is increased owing to the expansion thereof, and therefore the circumferential speed of the outer surface of the press roller 132 (i.e., transport speed of the recording sheet P) can be maintained at a constant level. Therefore, appearance of a streak in the image or a wrinkle of the recording sheet P during the fixing process can be prevented, without incurring complication of the structure. Consequently, occurrence of a trouble arising from the fluctuation in transport speed of the recording sheet P can be prevented, without incurring complication of the structure.

The disclosure is not limited to the foregoing embodiments, but may be modified in various manners. Although the image forming apparatus according to the disclosure is exemplified by a multifunction peripheral in the foregoing embodiments, the disclosure is broadly applicable to other types of electronic apparatuses such as a copier, a printer, and a facsimile machine.

Further, the configurations and arrangements according to the foregoing embodiments and variations, described with reference to FIG. 1 to FIG. 10, are merely exemplary, and in no way intended to limit the disclosure to those configurations and arrangements.

While the present disclosure has been described in detail with reference to the embodiments thereof, it would be apparent to those skilled in the art the various changes and modifications may be made therein within the scope defined by the appended claims.

What is claimed is:

1. A fixing device comprising:

a fixing element;

a heat source that heats a circumferential surface of the fixing element;

a press roller pressed against an outer circumferential surface of the fixing element, to form a nip region between the press roller and the fixing element, where a recording sheet is to pass, the recording sheet having a surface where a toner image to be fixed is formed;

a driver device that rotates the press roller; and a control device including a processor, and configured to act, when the processor executes a control program, as a controller that controls the heat source to set a temperature of the fixing element to a predetermined target temperature, and controls the driver device to set a rotation speed of the press roller to a predetermined target rotation speed, wherein the controller determines the target rotation speed by adding a predetermined correction value to a predetermined normal rotation speed on a basis of the temperature of the fixing element at start of a job, a type of the recording sheet, an ambient temperature, and an elapsed time from start of paper feed, and controls the driver device to set the rotation speed of the press roller to the target rotation speed determined, and the controller determines the target rotation speed by adding, as the correction value, a first correction value and a second correction value to the predetermined normal rotation speed, the first correction value being determined according to the temperature of the fixing element at the start of the job and the elapsed time from the start of the paper feed, the second correction value being determined according to the type of the recording sheet, the ambient temperature, and the elapsed time from the start of the paper feed.

2. The fixing device according to claim 1, further comprising:

a paper feed device that performs a primary paper feed including feeding the recording sheet to a resist position; and a resist roller pair that performs a secondary paper feed including feeding the recording sheet to a printing position and a fixing position, from the resist position, wherein the controller regards start of the secondary paper feed as the start of the paper feed.

3. The fixing device according to claim 1, wherein the fixing element includes an endless belt-like member, and is driven to rotate by rotation of the press roller.

4. The fixing device according to claim 1, wherein the press roller includes a cylindrical member covered with a layer formed of a synthetic resin.

5. The fixing device according to claim 1, further comprising:

a first sensor that detects a temperature of the fixing element; and a second sensor that detects the ambient temperature, wherein the controller determines the first correction value according to the temperature of the fixing element at the start of the job detected by the first sensor, and determines the second correction value according to the ambient temperature detected by the second sensor.

6. An image forming apparatus comprising:

the fixing device according to claim 1; and an image forming device that forms an image on the recording sheet, wherein the fixing device heat-presses the toner image formed on the recording sheet, by holding the recording sheet at the nip region between the fixing element and the press roller.

* * * * *